United States Patent [19]

Fabyan et al.

[11] Patent Number: 4,784,037

[45] Date of Patent: Nov. 15, 1988

[54] LOCKING APPARATUS FOR GATE VALVES

[75] Inventors: Joseph Fabyan, Livermore; Carl W. Williams, Manteca, both of Calif.

[73] Assignee: The United States of America as represented by the United States Department of Energy, Washington, D.C.

[21] Appl. No.: 453,981

[22] Filed: Dec. 28, 1982

[51] Int. Cl.[4] ..... F15B 15/26

[52] U.S. Cl. ..... 91/43; 91/44; 91/410; 92/27

[58] Field of Search ..... 92/24, 27, 28, 23, 25, 92/26; 91/43, 44, 189 R, 410

[56] References Cited

U.S. PATENT DOCUMENTS

| | | | |
|---|---|---|---|
| 2,349,244 | 5/1944 | Brown | 92/27 X |
| 2,802,483 | 8/1957 | Davis . | |
| 3,051,433 | 8/1962 | Dale et al. . | |
| 3,242,823 | 3/1966 | Sears et al. | 91/189 |
| 3,359,862 | 12/1967 | Modrich | 91/44 X |
| 3,523,675 | 8/1970 | Grove et al. . | |
| 3,695,578 | 10/1972 | Walther et al. | 251/94 |
| 3,699,850 | 10/1972 | Wagner | 92/24 |
| 3,889,576 | 6/1975 | Sheffer et al. | 92/24 X |
| 4,157,169 | 6/1979 | Norman | 251/195 |
| 4,238,111 | 12/1980 | Norman | 251/193 |

*Primary Examiner*—Abraham Hershkovitz

*Attorney, Agent, or Firm*—L. E. Carnahan; Roger S. Gaither; Judson R. Hightower

[57] ABSTRACT

A locking apparatus for fluid operated valves having a piston connected to the valve actuator which moves in response to applied pressure within a cylinder housing having a cylinder head, a catch block is secured to the piston, and the cylinder head incorporates a catch pin. Pressure applied to the cylinder to open the valve moves the piston adjacent to the cylinder head where the catch pin automatically engages the catch block preventing futher movement of the piston or premature closure of the valve. Application of pressure to the cylinder to close the valve, retracts the catch pin, allowing the valve to close. Included are one or more selector valves, for selecting pressure application to other apparatus depending on the gate valve position, open or closed, protecting such apparatus from damage due to premature closing caused by pressure loss or operational error.

10 Claims, 3 Drawing Sheets

LOCKING APPARATUS FOR GATE VALVES

The U.S. Government has rights in this invention pursuant to Contract No. W-7405-ENG-48 between the U.S. Department of Energy and the University of California, for the operation of Lawrence Livermore National Laboratory.

BACKGROUND OF THE INVENTION

This invention relates to gate valves and more particularly to fluid-operated gate valves including automatic interlock means for preventing closure due to loss of fluid supply pressure, or operational error.

Gate valves are used extensively in vacuum applications because of their short unrestricted flow path and larger available orifice or throat sizes. They are used as gating and isolation means for vacuum pumps and system components, access means or ports and interconnecting penetrations between apparatus.

In these latter two applications, analytical equipment or probes may be inserted through the gate valve throat while at vacuum pressures. Upon removal for repair or alteration the gate valve is then closed to maintain apparatus vacuum integrity.

A vacuum exerts a force on the valve gate, unlike high pressure applications, pulling the gate into the valve throat from its out of throat, open, position. Fluid pressure against the gate actuator keeps the valve fully open in fluid operated gate valves. Therefore, loss of fluid pressure with the gate under vacuum conditions allows the valve to creep closed. The extent of the gate valve closure depends on the operating parameters of the specific gate and vacuum apparatus. It is clear that if equipment or materials are present in the valve throat, premature closure can damage the gate, equipment or materials from sudden contact or from subsequent attempts at movement, such as when automatic insertion/removal means are activated. Additionally, any vacuum pump gated by a prematurely closing gate valve loses pumping capacity thereby allowing increased pressures in the vacuum apparatus with potentially deleterious effects. These same results occur in cases of operational error, when through error premature valve closure is instigated by operating personnel.

Existing gate valve locking devices fail to adequately protect valves and apparatus inserted therein, in high vacuum applications, because they are typically designed for locking a gate valve closed against high pressure, such as in U.S. Pat. No. 3,695,578 dated Oct. 3, 1972 issued to Walther, et. al., where locking a gate valve open under pressure conditions was stated as unnecessary.

Advanced valves with multiple gates and complex sealing means make mechanical locking devices that interact with the gate, such as in U.S. Pat. No. 3,523,675 dated Aug. 11, 1970 issued to M. H. Grove, et. al., more complex and impractical. Pressure actuated locking devices also require greater forces to disengage, when used on an evacuated gate housing, increasing hardware stress and risk of pressure intrusion into the vacuum.

Plasma confinement devices and reactors can use 100 or more gate valves with associated probes or equipment. In this environment, using locking devices that have pressure input sources separate from the valve actuating source; means for detecting the pressure level of the pressure input sources; or check valves in the pressure input lines, creates complexity that increases the likelihood of pressure loss. Locking devices utilizing pressure control valves for activating the lock also increase the amount of personnel interaction necessary, increasing the risk of operational error.

Adequate interlock capability for prevention of operational errors on vacuum systems with a large number of gate valves requires both automatic operation and a direct interaction with pressure actuators for other apparatus. A pressure control means functioning as an integral part of a locking device would provide this automatic operation with reduced complexity or need for human intervention.

It is also clear that many gate valves of proven reliability exist and there is no need to totally redesign an entire valve to achieve a reliable locking function. A simple, small scale, inexpensive valve add on or improvement is needed which minimizes changes in size or operating characteristics, allowing ready implementation on a variety of vacuum apparatus gate valves.

SUMMARY OF THE INVENTION

Accordingly, an object of the invention is to provide a locking apparatus for a fluid operated gate valve.

Another object of the invention is to provide a locking apparatus for fluid operated gate valves which does not require activation by operating personnel.

Still another object of the invention is to provide a locking apparatus for fluid operated gate valves which does not require a loss of pressure to activate the locking apparatus Yet another object of the invention is to provide a locking apparatus for fluid operated gate valves which is adapted to coordinate activation of other fluid pressure actuated apparatus which operate in the gate valve throat with the gate valve position.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve these objects, on a fluid operated gate valve, utilizing a piston connected to the valve actuator which moves in response to applied pressure within a cylinder having a cylinder head, the cylinder head is provided with a cylindrical chamber. A catch pin is slidably mounted in the cylindrical chamber so that a first end faces the cylinder and a second end is enclosed by the walls of the cylindrical chamber. There is a sealing means secured about the diameter of the catch pin and a force means disposed between the walls of the cylindrical chamber and the second end of the catch pin for projecting the first end of the catch pin into the cylinder. A single means for applying fluid pressure to both the cylinder and cylindrical chamber, in front of the sealing means, is provided. A catch block secured to the piston, on the side closest to the cylinder head, has a sloped leading edge for momentarily retracting the catch pin against the force means and a recess for engaging said catch pin until retracted by applied fluid pressure.

Yet another way to achieve these objects, on a fluid operated gate valve, is to provide the cylinder head with a first and a second cylindrical chamber each having a pressure input means and the second chamber having at least one pressure output means. A catch pin and a selector pin are slidably mounted in the first and second cylindrical chambers respectively with at least one sealing means secured about the diameter of the catch pin and at least three sealing means secured about the diameter of the selector pin. The selector pin has an internal chamber connecting a space between two of the three seals with the end of the pin always enclosed by the cylindrical chamber it is mounted in.

There is force means disposed between the walls of the cylindrical chambers and the enclosed ends of the catch and selector pins for projecting one end of each into the cylinder, substantially perpendicular to the cylinders longitudinal axis. A catch block secured to the piston, on the side closest to the cylinder head, has a sloped leading edge for retracting the catch and selector pins against their respective force means and a recess for engaging said catch pin until retracted by applied fluid pressure.

The catch pin engages the catch block on the piston whenever the piston moves to the cylinder head in opening the valve. Therefore, no additional action is necessary by a person actuating the valve in order to lock it open. Because activation of the locking apparatus does not depend on the presence of a pressure failure, premature closure is greatly minimized. The use of the same applied fluid pressure for retracting the catch pin as it moves the piston for closing the valve also means no additional action is necessary by a person initiating valve closure in order to release the lock. The elimination of operator interaction decreases operator error.

All hardware and functions are housed within the cylinder head reducing the amount of parts and fluid pressure piping. The locking apparatus is compatible with a variety of gate valves.

The presence of the selector valve allows for complex automation without exterior manually operated valves. This automation without the need for personnel to act provides a totally automatic protection capability and programable procedure of apparatus operation with a minimum of hardware.

A BRIEF DESCRIPTION OF THE DRAWINGS

The accompanying drawings, which are incorporated and form a part of the specification, illustrate an embodiment of the invention and, together with the description, serve to explain the principles of the invention.

DETAILED DESCRIPTION OF THE INVENTION

Figure 1:
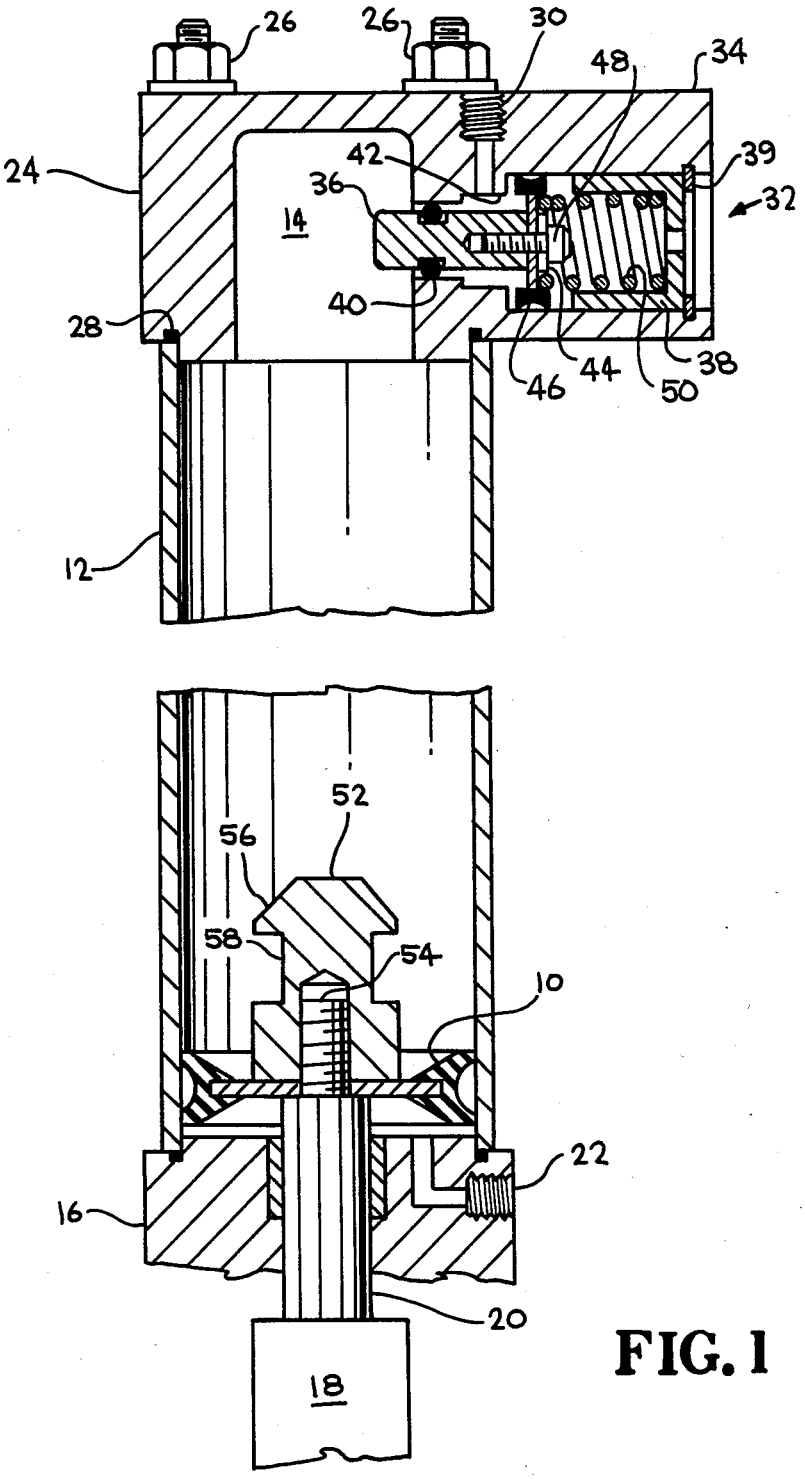
FIG. 1 is a schematic diagram of one embodiment of a fluid operated gate valve with a cylinder head having a spring loaded catch pin projecting into the cylinder ready to engage a catch block secured to the piston. The valve is shown in the closed position with the catch block and piston at the end of the cylinder away from the cylinder head.

FIG. 1 illustrates one embodiment of a locking apparatus for a fluid operated gate valve having a piston 10 slidably mounted in a cylinder 12 mounted on a housing 16 containing the valve gate 18 which is connected to piston 10 by a valve actuator rod 20 passing through an O-ring seal between housing 16 and cylinder 12. Fluid pressure applied through port 22 causes piston 10 to move within cylinder 12 away from port 22, transmitting this motion to valve gate 18 through valve actuator rod 20 moving the gate to its open position, out of the valve throat. The fluid pressure applied can be a variety of liquids or gases under pressure including but not limited to air, nitrogen, or hydraulic oil, with compressed air being preferred for vacuum operations. The pressurized fluid can be supplied by apparatus such as pressurized storage tanks, hydraulic pumps, or air compressors operated for this purpose. Port 22 is threaded to accept input means or tubing connectors for connection to the apparatus supplying fluid pressure.

A cylinder head 24 is attached to the cylinder opposite valve housing 16 using fastening means 26 which can be nuts tightened on bolts extending from valve housing 16. The overall dimensions of cylinder head 24 are determined by the required size of valve gate 18 and cylinder 12 for each particular application. Cylinder head 24 can be secured to cylinder 12 using other fastening means such as overlapping joints with screws or threading head 24 and cylinder 12. Cylinder head 24 is constructed of any material suitable for maintaining fluid pressures within cylinder 12 including but not limited to aluminum, stainless steel, or brass, with aluminum being preferred. Cylinder 24 has a cylindrical chamber 14 which forms an integral part of and is an extension of cylinder 12 when attached to cylinder 12. Pressure seal 28 is a large diameter flexible seal placed in a machined recess in head 24 which provides fluid pressure integrity for cylinder 12 operation. Port 30 provides a path for fluid pressure to enter cylinder 12 and move piston 10 toward valve housing 16 causing valve actuator 20 to move gate 18 into the valve throat, closing the valve. Port 30 is threaded like port 22 for connection to input means or tubing from fluid pressure sources provided to operate the gate valve.

Cylinder head 24, FIG. 1, has a substantially cylindrical chamber 32, having three different diameter sections, and extending radially outward from chamber 14 to outside wall 34 of cylinder head 24 and substantially perpendicular to the longitudinal axis of cylinder 12. The location of chamber 32 is dependant on the length of travel of piston 10 and the dimensions of catch block 52 discussed below. Catch pin 36 is slidably mounted in chamber 32 and the diameter of chamber 32 starting where it intersects chamber 14 is larger than, and depends on, the diameter of pin 36 and any seals used. The diameter of chamber 32 is larger in size from where it intersects port 30 to where it terminates at outer wall 34, providing a retaining edge 42 and accomodating parts contained therein. The walls of chamber 32 have a snap ring groove 39 adjacent to outer wall 34 for holding a snap ring for retaining a vented plug 38 within chamber 32. Vented plug 38 contains a spring 50 discussed below while being removable for installation of catch pin 36 and associated parts.

Catch pin 36 is slidably mounted in chamber 32 so that it can be moved to extend into chamber 14 with a seal 40 positioned about its diameter which operates to basically center the pin in chamber 32 and allow pressurization of chamber 32 behind seal 40. The position of seal 40 on pin 36 is determined by the dimensions of pin 36, chamber 32 and the relative position of port 30 such that: with pin 36 retracted into chamber 32, as described below, seal 40 resides on the side of port 30 closest outer wall 34; and with pin 36 extended into chamber 14 seal 40 resides on the side of port 30 closest chamber 14. Pin 36 is made of a material capable of long term repetitive use with minimum wear, such as hardened steel. One end of pin 36 is always enclosed by chamber 32 while the other end is extended into chamber 14. The end of pin 36 which remains in chamber 32 has a metal disc 44, supporting a fluid pressure seal 46, fastened to pin 36 with fastening means 48. Fastening means 48 is preferably a bolt extending through a hole in disc 44 into a threaded hole in pin 36 but can be other means including threading metal disc 44 and the mating end of pin 36.

Positioned between the metal disc 44 with pressure seal 46 and vented plug 38 of chamber 32 is a spring 50. Spring 50 forces pin 36 to move so that one end of pin 36 extends into chamber 14. Metal disc 44 with seal 46 abuts retaining edge 42 preventing pin 36 from moving entirely into chamber 14. At this point one end of pin 36 projects into chamber 14 in cylinder head 24 and in the path of travel for piston 10. It is preferred for the end of pin 36 projecting into chamber 14 to be tapered or rounded in order to reduce wear in interacting with a catch block 52.

The dimensions of catch block 52 are such that at the end of travel for piston 10 catch block 52 extends almost fully into chamber 14 without striking the walls of chamber 14. The end of travel for piston 10 is determined, by the limits of motion for gate 18 in valve housing 16. During valve opening, gate 18 moves enough to clear the valve throat and is typically stopped by abutting a bumper or limiting apparatus. In high vacuum applications a gate valve may have a bellows connected to shaft 20 and housing 16 for sealing the interior of housing 16 in which case the limit of compression for the bellows provides the limit of travel for rod 20.

Catch block 52 has a threaded hole 54 for fastening catch block 52 on the threaded end of valve actuator rod 20. Alternatively catch block 52 can be secured to the surface of piston 10 with other fastening means such as a setscrew through block 52 into actuator rod 20 or counter sunk bolts or screws through piston 10 into the end of block 52. Catch block 52 is fashioned with a sloped leading edge 56 for low stress deflection of pin 36 and a recess 58 of sufficient dimensions to accomodate pin 36 when extended by spring 50, and piston 10 is positioned adjacent to chamber 32 after reaching its end of travel in cylinder 12. The location of recess 58 on catch block 52 is determined in conjunction with the location of chamber 32 in cylinder head 24 so that chamber 32 and recess 58 are aligned with each other when piston 10 has reached its end of travel. Catch block 52 is preferably a cylinder with recess 58 being an annular recess machined along its length, but cubic geometrical shapes are sufficient.

In operation, fluid pressure applied through port 22 pressurizes cylinder 12 behind piston 10 causing piston 10 to move within cylinder 12 away from port 22, transmitting this motion to valve gate 18 through valve actuator rod 20 moving the gate to its open position, out of the valve throat. Piston 10 moves in cylinder 12 toward cylinder head 24 where catch block 52 enters into chamber 14. As catch block 52 enters chamber 14 the leading edge 56 contacts catch pin 36 which is extended into chamber 14 and causes the pin to retract into chamber 32 against spring 50. When piston 10 reaches its end of motion in cylinder 12 catch block 52, secured to piston 10, is positioned at a point within chamber 14 such that recess 58 is in substantial alignment with chamber 32 and catch pin 36 is forced to extend back into chamber 14 and recess 58 by spring 50. The presence of catch pin 36 in the recess of catch block 52 locks piston 10 in position at its end of travel and thus locks the valve in an open position.

To close the valve, applied fluid pressure at port 30, pressurizes that part of chamber 32 in front of pressure seal 46 and behind seal 40 forcing pin 36 to retract into chamber 32, against spring 50, removing the end of pin 36 from recess 58 in catch block 52. As pin 36 retracts from chamber 14, seal 40 is moved to the other side of port 30 allowing a free path for fluid pressure between port 30 and chamber 14. Fluid thus transmitted between chamber 14 and port 30 moves into cylinder 12 moving piston 10 toward valve housing 16. As piston 10 travels down cylinder 12 valve actuator rod 20 moves valve gate 18 into the valve throat closing the valve. The end of pin 36 is removed from recess 58 just before pressure is applied to cylinder 12 and piston 10 to decrease pressure exerted on pin 36 by block 52 and reduce wear.

Figure 2:
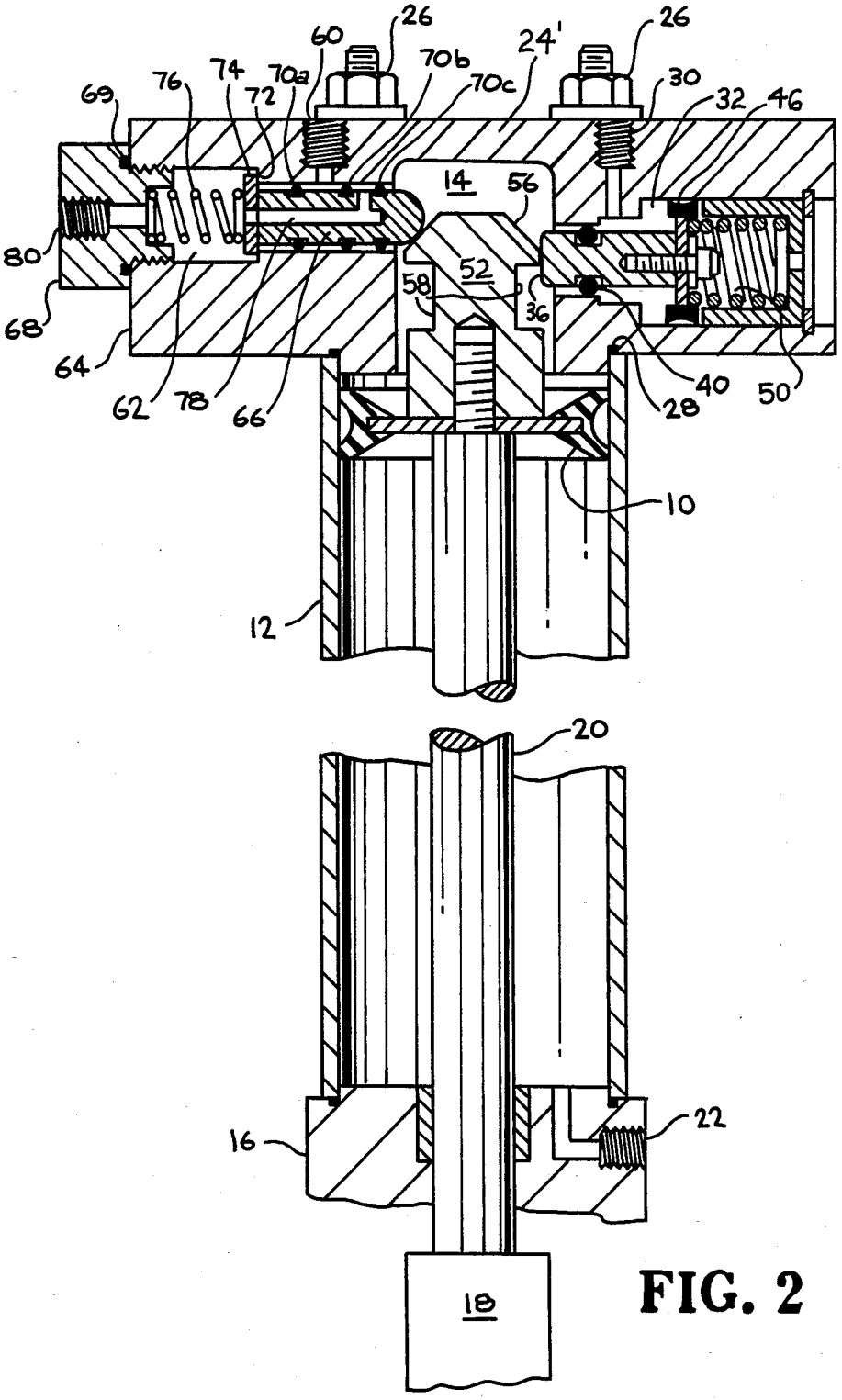
FIG. 2 is a schematic diagram of one embodiment of a fluid operated gate valve with a cylinder head having spring loaded catch and selector pins projecting into the cylinder and engaging the catch block secured to the piston. The valve is shown almost fully opened with the catch block and piston almost at the end of their travel near the cylinder head.

FIG. 2 illustrates a second embodiment of a locking apparatus for a fluid operated gate valve having a piston 10 slidably mounted in a cylinder 12 mounted on a housing 16 containing the valve gate 18 which is connected to piston 10 by a valve actuator rod 20 passing through an O-ring seal between housing 16 and cylinder 12. As previously described, fluid pressure applied through port 22, which is threaded to accept input means, causes piston 10 to move within cylinder 12 and through valve actuator rod 20 to move the gate to its open position. The fluid pressure applied can be a variety of liquids or gases under pressure including but not limited to air, nitrogen, or hydraulic oil, supplied from apparatus such as pressurized storage tanks, hydraulic pumps, or air compressors, with compressed gas being preferred.

A cylinder head 24' is attached to the cylinder opposite valve housing 16 using fastening means 26 which can be nuts tightened on bolts extending from valve housing 16. As before cylinder head 24' can be secured to cylinder 12 using other fastening means such as overlapping joints with screws or threading head 24 and cylinder 12. Cylinder head 24' is constructed of any material suitable for maintaining fluid pressures within cylinder 12 such as aluminum, stainless steel, or brass with aluminum being preferred. Cylinder head 24' has a cylindrical chamber 14 which forms an integral part of and is an extension of cylinder 12 when attached to cylinder 12. Pressure seal 28 is a large diameter flexible seal positioned in a channel for maintaining fluid pressure integrity of the cylinder 12 and cylinder head 24'.

Items 30 to 50 of FIG. 1 are functional equivalents of similarly constructed items of FIG. 2 and serve to operate catch pin 36 in the same manner so as to engage catch block 52.

In addition, cylinder head 24' has a second substantially cylindrical chamber 62, extending radially outward from chamber 14 to outside wall 64 of cylinder head 24' and perpendicular to the longitudinal axis of cylinder 12. The location of chamber 62 is dependant upon the limits of travel for piston 10 and the dimensions of catch block 52 as discussed below but must always be farther from piston 10 than chamber 32. Selector pin 66 is slidably mounted in chamber 62 with three or more sealing means 70*a*, 70*b*, and 70*c* about its diameter. The diameter of chamber 62 starting at chamber 14 depends on the diameter of pin 66 and any spacers or sealing means 70*a*–70*c* used. The diameter of chamber 62 is increased at a predetermined point along its longitudinal axis dependant upon the dimensions of selector pin 66 and the amount by which selector pin 66 must extend into chamber 14 in order to be retracted by catch block 52. The increase in diameter is sufficient to accomodate parts contained in chamber 62 and provide a retaining edge 72 which prevents selector pin 66 from sliding totally into chamber 14 by retaining disc 74 attached thereto. The walls of chamber 62 are threaded over part of its length extending in from outer wall 64 toward port 60, for accepting threaded plug 68. Threaded plug 68 seals chamber 62 where it intersects outer wall 64 with a pressure seal 69 and acts as a body for port 80, while being removable for installation of selector pin 66 and associated parts.

Selector pin 66 is slidably mounted in chamber 62, with three or more sealing means 70*a*–70*c* positioned about its diameter, so that it can be extended into chamber 14. Pin 66 is made of a material capable of long term repetitive use with minimum wear, such as hardened steel. One end of pin 66 is always enclosed by chamber 62 while the other end extends into chamber 14. The end always enclosed by chamber 62 has a metal plate 74 in the shape of a flat donut shaped ring fastened to it, using means such as welding disc 74 to pin 66 or threading metal disc 74 and the mating end of pin 66.

Positioned between metal ring 74 and plug 68 of chamber 62 is a spring 76 resting against plate 74 and plug 68. Spring 76 forces pin 66 to move so that one end of pin 66 extends into chamber 14. Upon sufficient motion of pin 66 plate 74 abuts retaining edge 72 preventing pin 66 from moving entirely into chamber 14. At this point pin 66 extends into chamber 14 in cylinder head 24 and in the path of travel for piston 10 where it will be contacted by and retracted by catch block 52. It is preferred for the end of pin 66 extending into chamber 14 to be tapered or rounded in order to reduce wear in interacting with a catch block 52.

Pin 66 has a fluid conducting passage 78 connecting the end of pin 66 enclosed by chamber 62 and facing port 80 to the space between either the first two sealing means 70*a*, 70*b* or the space between the second two sealing means 70*b*, 70*c*, depending on the location of pin 66. Fluid passage 78 allows fluid pressure to flow between port 80 and the space between two of the three sealing means. Therefore fluid pressure flows between ports 60 and 80 when the space between the sealing means is in alignment with port 60 and does not flow when the space is not aligned with port 60. This alignment occurs in response to the extension or retraction of pin 66 into or from chamber 14 and serves to select whether fluid pressure will flow between ports 60 and 80.

The dimensions of catch block 52 are chosen in conjunction with those of cylinder head 24' so that at the end of travel for piston 10 catch block 52 extends almost fully into chamber 14 without striking the walls of chamber 14. As previously stated, catch block 52 has a threaded hole 54 for fastening on the end of valve actuator rod 20 and alternately can be secured to the surface of piston 10 with other fastening means such as set-screws or countersunk bolts or screws. Catch block 52 is fashioned with a sloped leading edge 56 for low stress deflection of pins 36 and 66, and a recess 58 of dimensions to accomodate pin 36 when extended by spring 50 into chamber 14 and piston 10 has reached its end of travel in cylinder 12. Recess 58 is positioned on the length of catch block 52 such that at the end of travel for piston 10 this recess will be substantially aligned with chamber 32 but not chamber 62. Catch block 52 is preferably a cylinder with recess 58 being an annular recess machined along its length, but cubic geometrical shapes are acceptable.

As in the embodiment of FIG. 1, in operation of FIG. 2, fluid pressure applied through port 22 pressurizes cylinder 12 behind piston 10 causing piston 10 to move within cylinder 12 away from port 22, and, therefore, moving the gate to its open position. Catch block 52 enters chamber 14 contacting catch pin 36 and selector pin 66 with leading edge 56, causing them to retract into chambers 32 and 62 respectively against springs 50 and 76 respectively. As in the embodiment of FIG. 1, at the end of travel for piston 10 catch block 52 is positioned within chamber 14 such that recess 58 is in substantial alignment with chamber 32, and catch pin 36 is forced to extend back into chamber 14 and recess 58 by spring 50. The presence of catch pin 36 in the recess of catch block 52 locks piston 10 in position at its end of travel and thus locks the valve in an open position. At the same time, chamber 62 does not align itself with a recess in catch block 52 and, therefore, selector pin 66 is held in a retracted position as long as the valve remains open and catch block 52 is in chamber 14.

While selector pin is retracted into chamber 62 the space between sealing means 70*a*, 70*b* is aligned with port 60. Therefore, fluid pressure present at port 60 is transmitted through fluid passage 78 to port 80 or visa versa.

The valve is closed as before with applied fluid pressure at port 30, pressurizing chamber 32 in front of pressure seal 46 and behind seal 40 forcing pin 36 to retract into chamber 32. When catch pin 36 is withdrawn from catch block 52 fluid pressure is applied to chamber 14 moving piston 10 down cylinder 12, moving valve actuator rod 20 closing the valve.

When catch block 52 withdraws from chamber 14, selector pin 66 is forced to extend into chamber 14 again by spring 76. The space between sealing means 70*b*, 70*c* is no longer aligned with port 60 but the space between 70*a*, 70*b* becomes is aligned with port 60 so that fluid passage 78 no longer transmits fluid pressure between port 80 and port 60, as shown in FIG. 2. Therefore selector pin 66 selects whether fluid pressure will flow between ports 60 and 80 dependant upon the gate valve being locked open.

Figure 3:
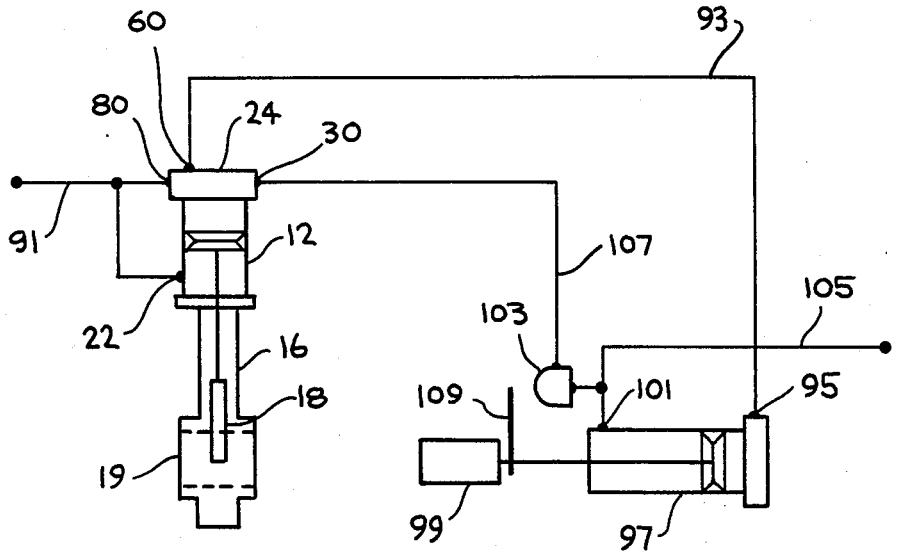
FIG. 3 is a schematic diagram of one embodiment of a system having a fluid operated gate valve with the locking apparatus and another apparatus to be inserted in the gate valve throat connected to the selector valve.

FIG. 3 is a schematic diagram of one embodiment of a protective interlock system for a fluid operated gate valve having a valve body 16, housing a valve gate 18 for covering valve throat 19, connected through an actuator rod to a piston slidably mounted in a cylinder 12 having a cylinder head 24 incorporating a catch pin and a selector pin for engaging a catch block secured to the piston.

Fluid pressure applied through pressure line 91 to ports 22 and 80 pressurizes cylinder 12 causing the piston to move the gate to its open position, out of valve throat 19. As in the embodiment of FIG. 2 when the gate valve is open the catch pin is forced into a recess in the catch block locking the valve open, and at the same time the selector pin is retracted into cylinder head 24' allowing fluid pressure to flow between ports 80 and 60.

Fluid pressure at port 60 is transported through pressure line 93 to port 95 of a pressure actuator means 97. Actuator means 97 operates so as to insert apparatus 99 into or through valve throat 19 in response to pressure applied to port 95, or remove apparatus 99 from or through valve throat 19 in response to pressure applied to port 101.

A trip valve 103 is connected in series with pressure line 107 between port 101, or pressure line 105, and gate valve port 30. Trip valve 103 is positioned adjacent to actuator means 97 so that an extension 109 of apparatus 99 contacts trip valve 103 when fully removed from valve throat 19. When extension 109 contacts trip valve 103 the valve opens connecting pressure from line 105 to line 107 causing pin 36 to be withdrawn from catch block 52. Movement of apparatus 99 into valve throat 19 removes extension 109 contact with trip valve 103 closing valve 103 and disconnecting the flow of fluid pressure from line 105 to line 107 allowing pin 36 to extend into chamber 14 by spring 50.

Therefore, pressure applied from gate valve port 60 through pressure line 93 to port 95 moves apparatus 99 into open valve throat 19 and disconnects pressure line 107. With pressure line 107 disconnected, no pressure can be applied to port 30 and the gate valve cannot be closed with apparatus 99 in place.

Applied pressure through pressure line 105 to port 101 removes apparatus 99 from valve throat 19 and trips valve 103 reconnecting pressure line 107 to port 101, or pressure line 105, applying fluid pressure to port 30. Applied fluid pressure at port 30 retracts the catch pin from the catch block, unlocking the valve and moves the piston to close the valve.

The foregoing description of preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A locking apparatus for fluid operated valves having a piston connected to the valve actuator which moves in response to applied pressure within a cylinder housing, comprising:

(a) a cylinder head secured to one end of said cylinder housing and having a first and a second cylindrical chamber with a first and a second fluid pressure input means connected to said first and second cylindrical chambers respectively, and one or more fluid pressure output means connected to said second cylindrical chamber;

(b) a catch pin slidably mounted within said first cylindrical chamber with a first end facing said cylinder and a second end facing away from said cylinder and enclosed by the walls of said first cylindrical chamber;

(c) a first sealing means secured about said catch pin diameter immediately adjacent to said second end, a second sealing means secured about said catch pin diameter at a location spaced from said first end and spaced from said first sealing means, said first fluid pressure inlet means being located in said first cylindrical chamber so as to be intermediate said first and second sealing means of said catch pin;

(d) a force producing means disposed within said first cylindrical chamber and in abutment with said second end of said catch pin for projecting said first end of said catch pin into said cylinder substantially perpendicular to the longitudinal axis of said cylinder;

(e) a selector pin slidably mounted within said second cylindrical chamber with a first end facing said cylinder and a second end facing away from said cylinder and enclosed by the walls of said second cylindrical chamber, having at least three sealing means about its diameter being spaced apart along its length, and further having an internal passage for conducting fluid between said second end of said selector pin and one of the spaces between said sealing means;

(f) force producing means disposed within said second cylindrical chamber and in abutment with said second end of said selector pin for projecting said first end of said selector pin into said cylinder substantially perpendicular to the longitudinal axis of said cylinder;

(g) a catch block secured to said piston with a sloped edge for retracting said catch pin and said selector pin into said first and second cylindrical chambers respectivley, and having a recess for engaging said catch pin for being held substantially stationary by said catch pin until released by applied fluid pressure; and (h) means for applying fluid pressure to at least said first cylindrical chamber for moving said catch pin in a direction away from said cylinder and out of engagement with said recess of said catch block and allowing fluid pressure to pass around said first end of said catch pin into said cylinder housing.

2. The locking apparatus for fluid operated valves as recited in claim 1 wherein each of said force producing means is a spring, each of said springs being secured in one of said first and second cylindrical chambers and abutting said second end of said catch pin and said selector pin respectively.

3. The locking apparatus for fluid operated valves as recited in claim 1 wherein said first sealing means is an O-ring seal mounted on a metal backing ring which is secured to said second end of said catch pin.

4. The locking apparatus for fluid operated valves as recited in claim 1, wherein said second sealing means is secured about the diameter of said catch pin and spaced apart from the first sealing means at a distance determined by the dimensions of said catch pin, said first cylindrical chamber, and the location of said first fluid pressure inlet means so as to allow pressurizing the space between said first and second sealing means and for moving said catch pin against said force producing means and in a direction away from said cylinder.

5. The locking apparatus for fluid operated valves as recited in claim 4 wherein said second sealing means is an O-ring having a low coefficient of friction and mounted in a recess in said catch pin diameter.

6. The locking apparatus for fluid operated valves as recited in claim 4 wherein said sealing means are O-ring seals mounted in recesses in the diameter of said selector pin.

7. An improvement to fluid operated gate valves having a piston connected to a valve actuator which moves in response to applied pressure within a cylinder housing having a cylinder head, the improvement comprising:

(a) a catch pin slidably mounted within a first cylindrical chamber in said cylinder head so that a first end faces and can be extended into said cylinder, and a second end is enclosed by the walls of said first cylindrical chamber, and having a pair of spaced sealing means secured about the diameter thereof, and a first fluid pressure inlet means being connected to said first cylindrical chamber intermediate said pair of spaced sealing means;

(b) force producing means disposed within said first cylindrical chamber in abutment with said second end of said catch pin for extending said first end into said cylinder perpendicular to the travel of said piston;

(c) a catch block secured to said piston having a recess for engaging said catch pin until released by applied fluid pressure;

(d) a second cylindrical chamber in said cylinder head having a second fluid pressure inlet means and one or more fluid pressure output means connected thereto;

(e) a selector pin slidably mounted within said second cylindrical chamber with a first end facing said cylinder and a second end enclosed by the walls of said second cylindrical chamber, having at least three parallel sealing means about its diameter being spaced apart along its length and further having an internal passage for conducting fluid between said second end of said selector pin and one of the spaces between said sealing means; and (f) force producing means disposed within said second cylindrical chamber and in abutment with said second end of said selector pin for projecting said first end of said selector pin into said cylinder substantially perpendicular to the longitudinal axis of said cylinder.

8. The improvement of claim 7, wherein said first cylindrical chamber is provided with three sections of different and increasing diameter, a first and smaller of said three sections being located adjacent to said cylinder, said first sealing means and said force producing means being located in a third and larger of said three sections of said first cylindrical chamber, said first fluid pressure inlet means being connected to said first cylindrical chamber at an intermediate section of said three sections, another sealing means being secured about said first end of said catch pin and spaced from said first sealing means and adapted to be moved by said catch pin into said smaller and intermediate sections of said first cylindrical chamber, whereby first fluid under pressure is directed via said fluid pressure inlet means to move said catch pin away from said cylinder causing said another sealing means to move from said smaller section to said intermediate section of said first cyindrical chamber thereby allowing fluid under pressure to be directed into said cylinder.

9. The improvement of claim 8, wherein said another sealing means comprises an O-ring mounted in a recess in said first end of said catch pin.

10. The improvement of claim 7, wherein said first sealing means comprises a flexible sealing member mounted on a metal backing ring which is secured to said second end of said catch pin.

* * * * *